US006260301B1

(12) United States Patent
Aigner et al.

(10) Patent No.: US 6,260,301 B1
(45) Date of Patent: Jul. 17, 2001

(54) PISTOL, WHOSE HOUSING IS COMPOSED OF PLASTIC

(75) Inventors: Friedrich Aigner, St. Valentin; Wilhelm Bubits, Brunn/Gebirge, both of (AT)

(73) Assignee: Steyr Mannlicher AG & Co KG, Vienna (AT)

( * ) Notice: Subject to any disclaimer, the term of this patent is extended or adjusted under 35 U.S.C. 154(b) by 0 days.

(21) Appl. No.: 09/373,671

(22) Filed: Aug. 13, 1999

(30) Foreign Application Priority Data

Aug. 13, 1998 (AT) ..... 532/98 U

(51) Int. Cl.[7] ..... F41C 23/10
(52) U.S. Cl. ..... 42/71.02; 42/75.02
(58) Field of Search ..... 42/71.02, 75.01, 42/75.02

(56) References Cited

U.S. PATENT DOCUMENTS 4,409,882 * 10/1983 Blackshaw et al. ..... 89/163
5,293,708 * 3/1994 Strayer et al. ..... 42/75.03
5,669,169 * 9/1997 Schmitter et al. ..... 42/75.01

* cited by examiner

*Primary Examiner*—Stephen M. Johnson
(74) *Attorney, Agent, or Firm*—Bachman & LaPointe, P.C.

(57) ABSTRACT

The pistol comprises a housing composed of plastic and a barrel slide (which contains a barrel and a breech and is guided in the longitudinal direction with respect to the housing) as well as a trigger mechanism. In order to allow plastics technology to be used to a large extent, with high precision and easy assembly, a single multifunction part, which is composed of metal, is inserted removably into the housing, on which multifunction part the guides for the barrel slide are formed and in which the elements of the trigger mechanism are mounted and guided. The multifunction part has a hole which holds the disassembly lever shaft and thus produces the connection between the housing and the multifunction part. Furthermore, a recess for a projection of the multifunction part is provided in the rear wall of the housing.

1 Claim, 3 Drawing Sheets

PISTOL, WHOSE HOUSING IS COMPOSED OF PLASTIC

BACKGROUND OF THE INVENTION

The present invention relates to a pistol which comprises a housing composed of plastic, a barrel slide (which contains a barrel and a breech and is guided in the longitudinal direction with respect to the housing) and a trigger mechanism. Pistols of widely differing systems are thus affected.

With the aim of making pistols as light as possible, efforts are being made to make as many parts as possible from plastic. Owing to the high forces which occur, this is subject to limits, although these are receding owing to the progress in plastics technology. Certain parts of the housing, such as the guides for the barrel slide, still have to be composed of metal. Thus, although it has become possible to design a housing composed of plastic, certain parts (such as the guides for the barrel slide) still have to be composed of metal. In some cases, these have been connected non-detachably to the housing by means of extrusion coating, and in some cases they are inserted individually into the housing.

Such a pistol is known in practice, the GLOCK Model 17. In this pistol, the barrel slide guides are individual extrusion-coated parts. The manufacture of such plastic parts is expensive and complicated, while the metal parts must be inserted into the injection molding die accurately in position and corrected for shrinkage. The mountings for the parts of the trigger mechanism and the control parts for locking the barrel are individually inserted as assemblies into the housing, resulting in further dimensional inaccuracies with respect to one another and with respect to the barrel slide guides. If individual extrusion-coated parts become worn or damaged, the entire housing must be replaced. A further disadvantage is that the individual parts are difficult to fit into the housing, since accessibility to the interior of the housing is poor. This disadvantage occurs irrespective of the choice of material.

It is an object of the present invention to provide a pistol construction which allows for the use of plastics technology to a large extent, and which provides high precision and simple assembly.

SUMMARY OF THE INVENTION

According to the invention, the foregoing object is achieved wherein a single, metal, multifunction part is removably inserted into the housing, and on the multifunction part the guides for the barrel slide are formed, and the elements of the trigger mechanism are mounted and guided.

The multifunction part can easily be manufactured and processed with high precision, is fitted with all the moving parts, and is not inserted into the housing until after the fitting has been done. It can be removed again for repair purposes. All parts are easily accessible during assembly and repair. As a result, the relative position of those parts which are essential to operation is defined considerably more accurately, and is much less susceptible to adverse influences, even in the event of expansion differences. Overall, greater precision is achieved, with reduced costs.

In the case of a pistol having a disassembly lever shaft which is mounted transversely in the housing, the multifunction part in an advantageous development has a hole, which holds the disassembly lever shaft and thus produces the connection between the housing and the multifunction part. The multifunction part is thus connected to the housing without any specific fastening means. Furthermore, when disassembling the weapon, it also makes sense to pull out the disassembly lever for the next stage of disassembly.

In one preferred embodiment, a recess for a projection of the multifunction part is provided in the rear wall of the housing. This makes disassembly and assembly particularly simple. After pulling on the disassembly lever shaft, the multifunction part is pulled slightly forward, and is then simply lifted off.

In the case of a pistol having a barrel which can be locked in the barrel slide, the invention achieves a further simplification in that the control means for locking are formed on the multifunction part.

BRIEF DESCRIPTION OF THE DRAWINGS

The invention will be described and explained in the following text with reference to figures, in which.

DETAILED DESCRIPTION

Figure 1:
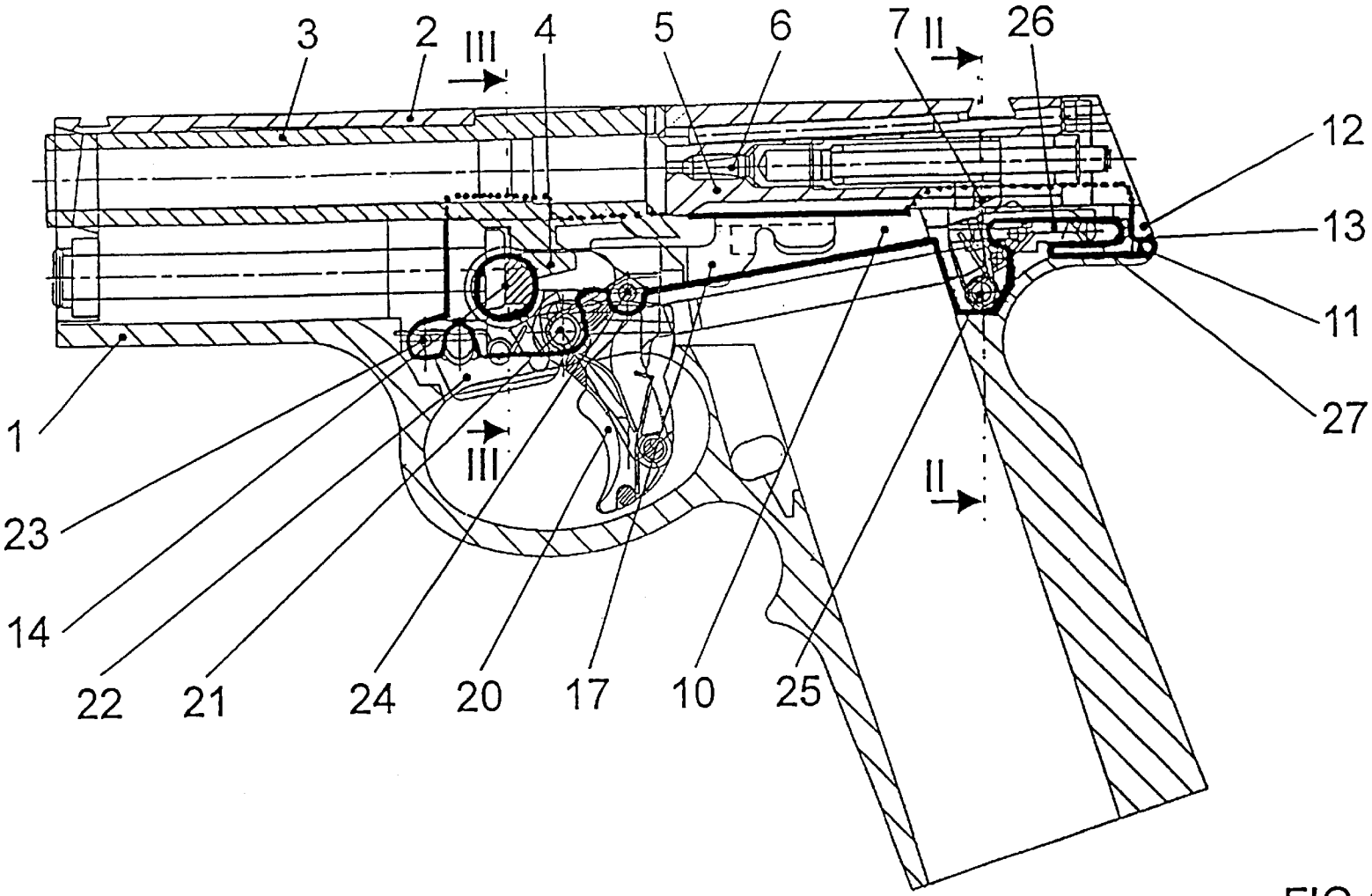
FIG. 1 shows a longitudinal section through a pistol according to the invention.
Figure 3:
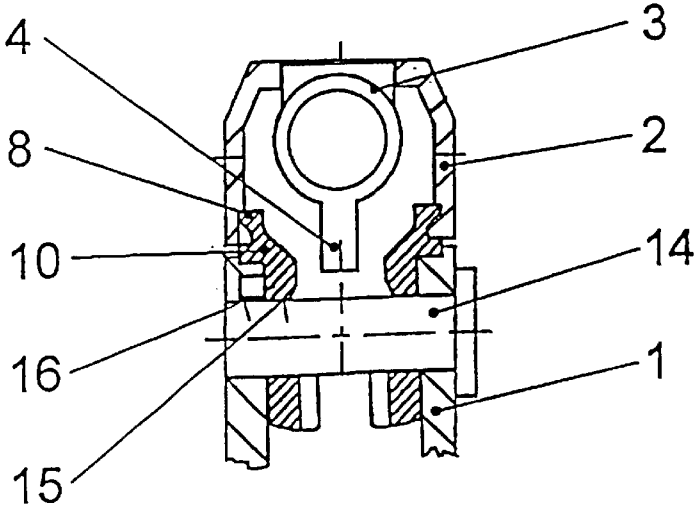
FIG. 3 shows a cross section along III—III in FIG. 1.
Figure 2:
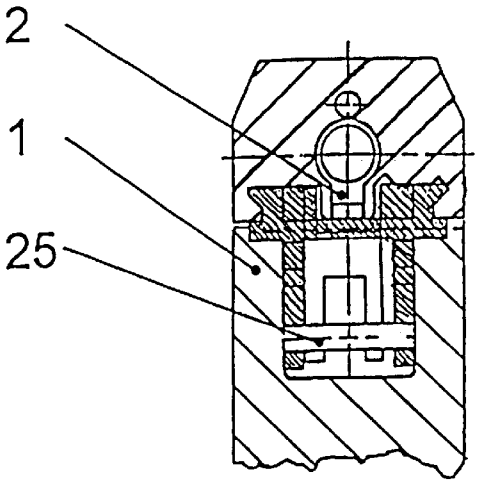
FIG. 2 shows a cross section along II—II in FIG. 1.

The pistol illustrated in FIGS. 1, 2 and 3 comprises a plastic housing 1 and a barrel slide 2 which can be moved on this plastic housing 1 in the firing direction and, a barrel 3 with control attachments 4, a block 5, a sear 6 with a sear tab 7 and guides 8. A hammer can also be provided instead of the sear. The entire housing 1 is composed of plastic. A metallic multifunction part 10 is inserted removably into this housing 1. For this purpose, this multifunction part 10 has, at the rear, a projection 11 which engages in a corresponding recess 13 in the rear wall 12. Two such projections 11 are provided alongside one another in this case.

A disassembly lever shaft 14 (FIG. 3) is inserted into holes 15 in the multifunction part 10 and into holes 16 in the side parts of the plastic housing 1. The projections 11 and the disassembly lever shaft 14 hold the multifunction part firmly in the housing 1. The multifunction part 10 can be removed from the housing 1 after pulling out the disassembly lever shaft 14, and pulling the projections 11 out of the recesses 13. A breech catch lever 17 can also be mounted on the disassembly lever shaft 14.

A trigger 20 is mounted in a bearing pin 21, which is inserted in the multifunction part 10. The spring of a trigger safety device 22 is supported on a pin 23. Another moving part (for example another safety device) is supported in a further pin 24. A pivoting pin 25 is inserted in the rear part of the multifunction part. These pins 23, 24, 25 are likewise mounted in the multifunction part. Finally, a guide 27 for a release lever 26 is formed on the multifunction part 10. All the moving parts of the trigger apparatus are thus connected to the multifunction part 10. In consequence, all these parts can be mounted on the multifunction part 10 first of all, before the complete unit is finally inserted into the housing 1.

Figure 4:
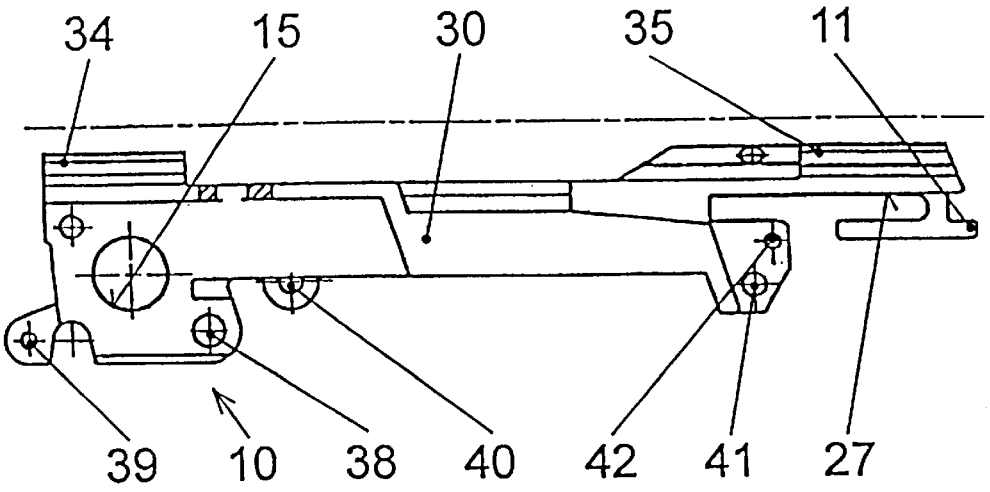
FIG. 4 shows a side view of the multifunction part according to the invention.
Figure 5:
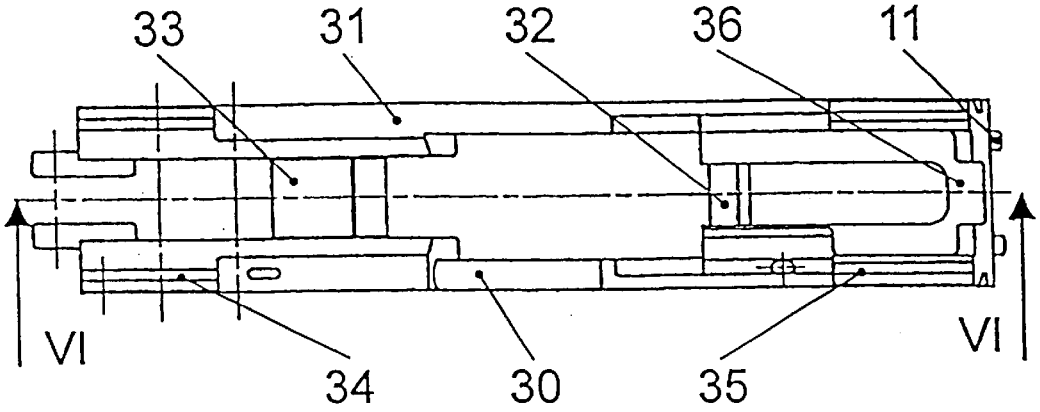
FIG. 5 shows a plan view of FIG. 3.
Figure 6:
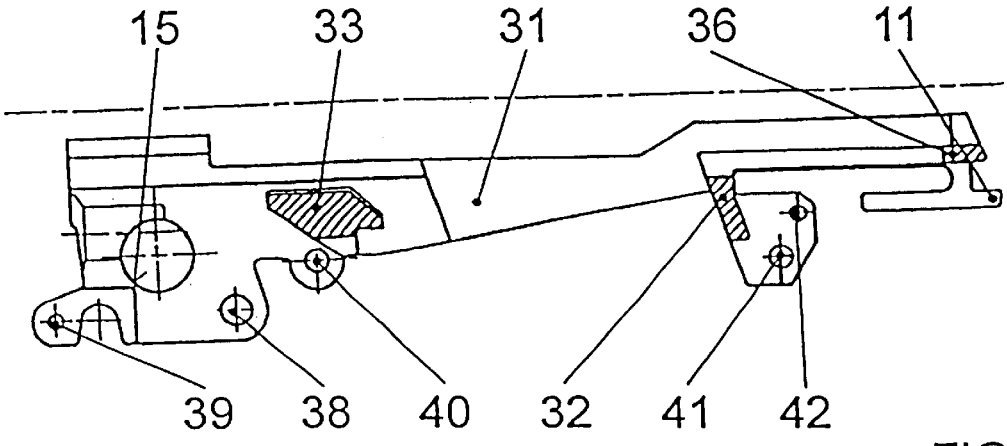
FIG. 6 shows a longitudinal section along IV—IV in FIG. 5.

In FIGS. 4, 5, 6, the multifunction part 10 is shown without any attachments. It comprises a right-hand and left-hand side part 30, 31, which are connected to one another via a first bridge 32, a second bridge 33 (which, at the same time, is the control means for locking the barrel 3) and, at the rear, by a third bridge 36. The upper edges of each of the side parts 30, 31 are fitted with a front guide 34 and a rear guide 35 for the barrel slide 2, whose guides 8 engage in these guides 34 and 35. The two projections 11 are also formed at the rear on the third bridge 36. The hole 15 for the disassembly lever shaft 14 is located in the front part of the multifunction part 10.

Furthermore, various holes are provided in the two side parts 30, 31, to be precise a hole 38 for the bearing pin 21, a hole 39 for the pin 23, a hole 40 for the other pin 24 in the front part and, in the rear part, a hole 41 for the pivoting pin 25 and a hole 42 for a further part of the trigger mechanism. The holes 41, 42 as well as the guide 27 in the configuration shown relate to a trigger device according to AT-UM Application 477/98. The multifunction part 10 can be produced in various ways, being milled from solid, as a precision casting, by welding individual parts together, or even as a stamped sheet-metal part.

The description of an exemplary embodiment is not intended to limit the invention in any way to a specific method of construction or method of operation of a pistol. Any desired holes and guides can thus be applied to the multifunction part 10, at any desired points.

What is claimed is:

1. A pistol comprising a housing; a barrel slide movably mounted on the housing for movement in a firing direction with respect to a barrel; and a trigger mechanism located, at least in part, within the housing, the improvement which comprises a multifunction metal part removably insertable within said housing, said multifunction metal part being provided with guides for the barrel slide and means for supporting the trigger mechanism, said multifunction metal part and housing are each provided with a transverse hole which receives a shaft for connecting the housing and the multifunction metal part together, the housing has a rear wall which is provided with a recess for receiving a projection on the multifunction metal part the multifunction metal part includes control means for locking said barrel in the barrel slide.

* * * * *